US007249638B2

(12) United States Patent
Bodine et al.

(10) Patent No.: US 7,249,638 B2
(45) **Date of Patent: *Jul. 31, 2007**

(54) IMPACT WRENCH ANVIL AND METHOD OF FORMING AN IMPACT WRENCH ANVIL

(75) Inventors: Thomas J Bodine, Glenwood, MD (US); David S Bruner, Bel Air, MD (US); Alan M Paris, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 28 days.

This patent is subject to a terminal disclaimer.

(21) Appl. No.: 11/031,726

(22) Filed: Jan. 7, 2005

(65) Prior Publication Data

US 2006/0151188 A1 Jul. 13, 2006

(51) Int. Cl.
*B25B 19/00* (2006.01)

(52) U.S. Cl. ..... 173/93; 173/104; 173/171

(58) Field of Classification Search ..... 173/93.5, 173/93.6, 93, 104
See application file for complete search history.

(56) References Cited

U.S. PATENT DOCUMENTS

| | | | | |
|---|---|---|---|---|
| 2,954,994 | A | | 10/1960 | Beers |
| 3,119,456 | A | | 1/1964 | Burnett |
| 3,180,435 | A | | 4/1965 | McHenry |
| 3,428,137 | A | | 2/1969 | Schaedler et al. |
| 3,600,160 | A | * | 8/1971 | Simcoe et al. ..... 420/127 |
| 3,605,914 | A | | 9/1971 | Kramer |
| 3,734,515 | A | | 5/1973 | Dudek |
| 3,885,995 | A | * | 5/1975 | Cunningham et al. ..... 148/217 |
| 3,890,051 | A | | 6/1975 | Biek |
| 4,191,599 | A | * | 3/1980 | Stickels et al. ..... 148/233 |
| 4,249,964 | A | * | 2/1981 | Bambuch et al. ..... 148/217 |
| 4,513,827 | A | | 4/1985 | Dubiel |
| 4,659,241 | A | * | 4/1987 | Bamberger et al. ..... 384/625 |
| 4,865,485 | A | | 9/1989 | Finnefrock, Sr. |
| 5,038,869 | A | | 8/1991 | Olson |
| 5,438,894 | A | | 8/1995 | Pearce |
| 5,595,099 | A | | 1/1997 | Pusateri et al. |

(Continued)

FOREIGN PATENT DOCUMENTS

DE 1478993 1/1962

(Continued)

OTHER PUBLICATIONS 4-48. 8620H Steel: Effect of Variation in Carburizing Treatments, Source: George Krauss, Principles of Heat Treatment of Steel, American Society for Metals, Metals Park OH, 1980, p. 264.

(Continued)

*Primary Examiner*—John Sipos
*Assistant Examiner*—Michelle Lopez
(74) *Attorney, Agent, or Firm*—Harness, Dickey & Pierce, P.L.C.

(57) ABSTRACT

An anvil adapted to be received within an impact wrench comprises a round body and a square head. The square head is formed at an end of the round body. A tapered ramp extends from the round body to the square head. A radius is formed in the tapered ramp.

11 Claims, 2 Drawing Sheets

U.S. PATENT DOCUMENTS

| | | | | |
|---|---|---|---|---|
| D384,563 | S | 10/1997 | Robinson | |
| 5,910,197 | A | 6/1999 | Chaconas | |
| 6,126,897 | A * | 10/2000 | Aihara et al. | 420/106 |
| 6,179,063 | B1 | 1/2001 | Borries et al. | |
| 6,364,974 | B1 * | 4/2002 | Kobasko | 148/663 |
| 6,446,735 | B1 | 9/2002 | Chen | |
| 6,672,183 | B2 | 1/2004 | Johnson | |
| 6,702,981 | B2 * | 3/2004 | Hetzner | 420/112 |
| 6,938,526 | B2 | 9/2005 | Milbourne et al. | |
| 7,036,406 | B2 | 5/2006 | Milbourne et al. | |

FOREIGN PATENT DOCUMENTS

| | | |
|---|---|---|
| DE | 1603945 | 3/1967 |
| DE | 1939262 | 8/1969 |
| DE | 2508316 | 2/1975 |
| DE | 4402739 | 1/1994 |
| DE | 20118029 | 11/2001 |
| DE | 20201733 | 2/2002 |
| EP | 0092127 | 4/1983 |
| EP | 0885693 | 12/1988 |
| EP | 0719618 | 7/1996 |
| EP | 0721823 | 7/1996 |
| EP | 0747174 | 12/1996 |
| GB | 1014081 | 12/1965 |

OTHER PUBLICATIONS

"Werkstoffkunde Stahl, Band 2: Anwendung" 1985, Springer-Verlag, Berlin, XP002375006, pp. 164-181.

Robert W. Cahn, Peter Haasen, Edward J. Kramer, Frederick Br. Pickering: "Material Science and Technology, vol. 7: Constitution and Properties of Steels" 1998, Wiley, Weinheim, XP002375007, pp. 147-181.

* cited by examiner

IMPACT WRENCH ANVIL AND METHOD OF FORMING AN IMPACT WRENCH ANVIL

FIELD OF THE INVENTION

The present invention relates to an impact wrench and more particularly to an improved anvil in an impact wrench.

BACKGROUND OF THE INVENTION

The traditional design of an anvil for use in an impact wrench includes a round portion that transitions to a square portion. The round portion is received within the impact wrench and acts as a bearing journal. The square portion is received within an impact socket. The transition from the round cross section to the square cross section inherently creates sharp corners or small radii within the transition.

These sharp corners or small radii may create some inefficiencies in the design. Initially there is minimal clearance between the square portion of the anvil and the impact socket when the pieces are new. However, the impact socket may, over a long period of use, become "damaged", resulting in a looser fit to the square portion of the anvil. This increased clearance between the square portion interface and the impact socket allows the centerline of the square portion of the anvil and the centerline of the impact socket to become non-parallel. When this occurs, the theoretical line contact between the two that exists axially along the interface of the square portion and the impact socket becomes points of contact. These points of contact form at the sharp radii in the transition between the round body and the square drive and lead to zones of increased stress.

Moreover, as the impact socket becomes "damaged", the corners of the impact socket tend to "dig" into the sharp radii in the transition. This digging between the impact socket and the square portion can damage the anvil, resulting in stress concentration zones. As the stress builds at these points, the anvil may fail at the stress concentration zones. This then can contribute to an early failure of the anvil.

One solution to the problem of sharp radii in an anvil is to increase the overall strength of the anvil. For example, increases in the amount of alloying elements such as carbon or nickel in the steel have been attempted. Unfortunately, this alloying leads to increases in the amount of retained austenite within the anvil. The retained austenite inhibits strength for impact loading and often leads to fatigue failures. Accordingly, there remains a need to provide an improved anvil design that reduces the stress concentration zones and prolongs the life of the anvil.

SUMMARY OF THE INVENTION

An anvil adapted to be received within an impact wrench is provided. The anvil comprises a round body and a square head formed at an end of the round body. A tapered ramp extends from the round body to the square head. A radius is formed in the transition from the tapered ramp to the square head. The radius has a curvature of about 2 mm. In the transition, all surfaces are blended to eliminate sharp corners and small radii. In another embodiment of the invention, an anvil for an impact tool is provided having a body formed of a steel having less than 0.15% carbon and between about 2.95 and about 3.55% Ni, and between about 1.0 and about 1.45% Cr. The body has an exterior layer having a carbon content greater than 0.15% carbon formed by carburization. The carburized exterior layer has a microstructure having more than 90% tempered martensite formed from a plurality of heat treatment/quenching cycles.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses.

Figure 1:
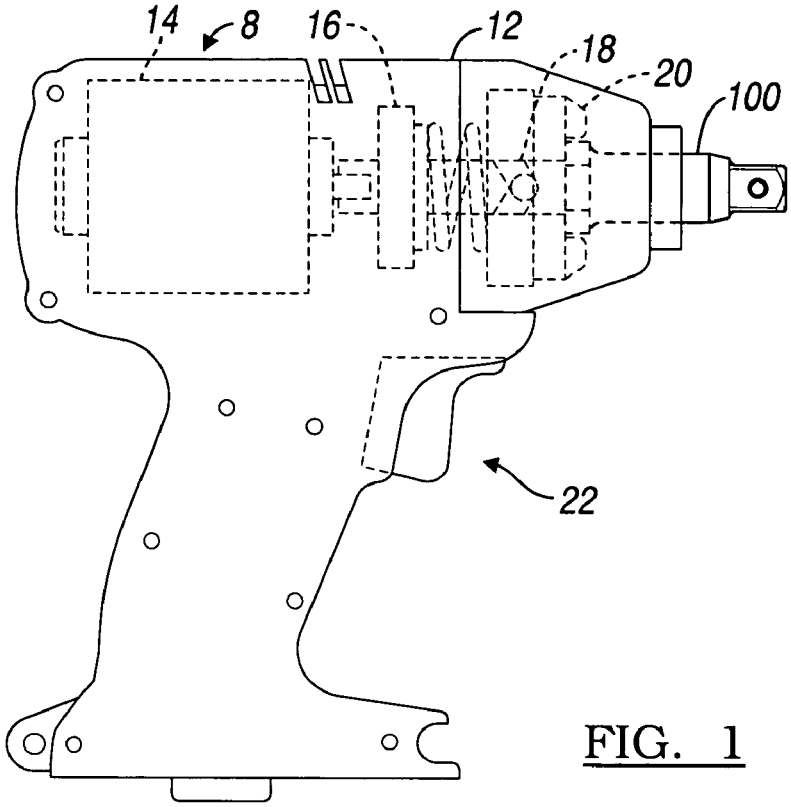
FIG. 1 is a side view of an exemplary impact wrench having an anvil constructed according to the principles of the present invention.
Figure 2:
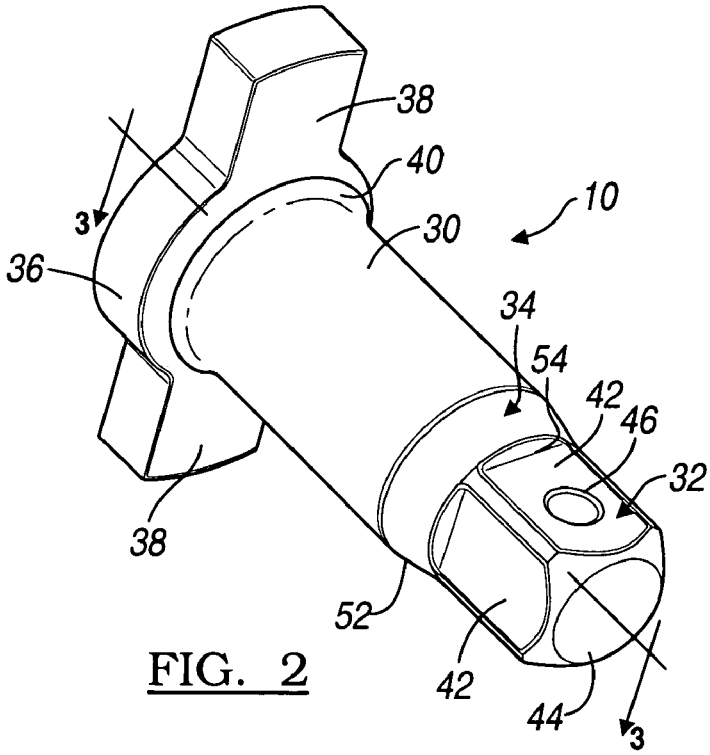
FIG. 2 is a perspective view of an anvil according to the teachings of the present invention.

With reference to FIG. 1 of the drawings, an exemplary impact wrench 8 is illustrated to include an improved anvil 100 that is constructed in accordance with the teachings of the present invention. The impact wrench 8 also includes a housing 12 containing an electric motor 14 whose output is coupled to a gear assembly 16. The gear assembly 16 transfers the output to a cam shaft 18 which in turn drives an impactor 20. The improved anvil 100 is mounted within the impactor 20. A trigger and handle assembly 22 mounted to the housing 12 is used to activate the electric motor 14.

The round body 30 is generally cylindrical in shape and includes an enlarged base 36 at one end thereof. The enlarged base 36 includes two locking wings 38 extending therefrom and adapted to be received within the impactor 20. A base radius 40 extends around the circumference of the enlarged base 36 and extends to the round body 30 thereby connecting the two portions.

The square drive head 32 includes side faces 42 and a front face 44. An optional detent pin hole 46 extends from one of the side faces 42 through the drive head 32. The detent pin hole 46 is sized to receive a detent pin, not shown. The square drive head 32 is adapted to be inserted into a tool piece, not shown.

The transition zone 34 includes a tapered ramp 52 extending from the round body 30 to the square drive head 32. A radii 54 is formed at the corners of the square drive head 32 where the faces 42 meet the tapered ramp 52. These radii 54 in the past have formed stress concentration zones and are the sources of potential material failure of the anvil 100.

Figure 3:
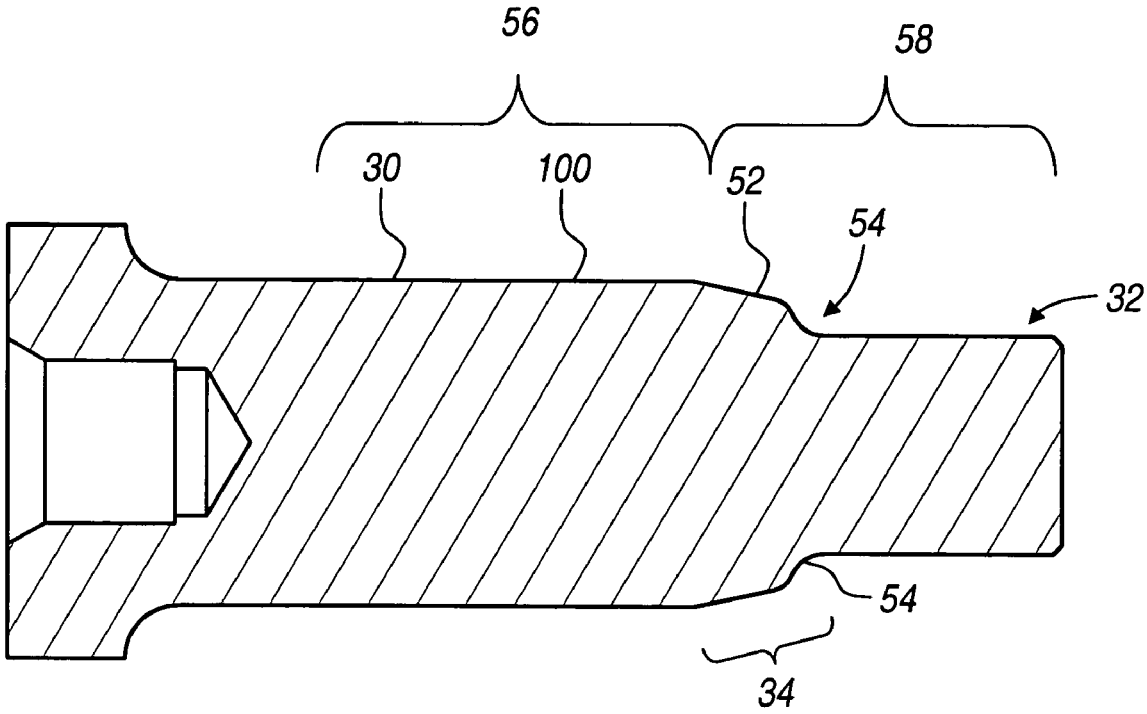
FIG. 3 is a cross sectional view of the anvil shown in FIG. 2.
Figure 4:
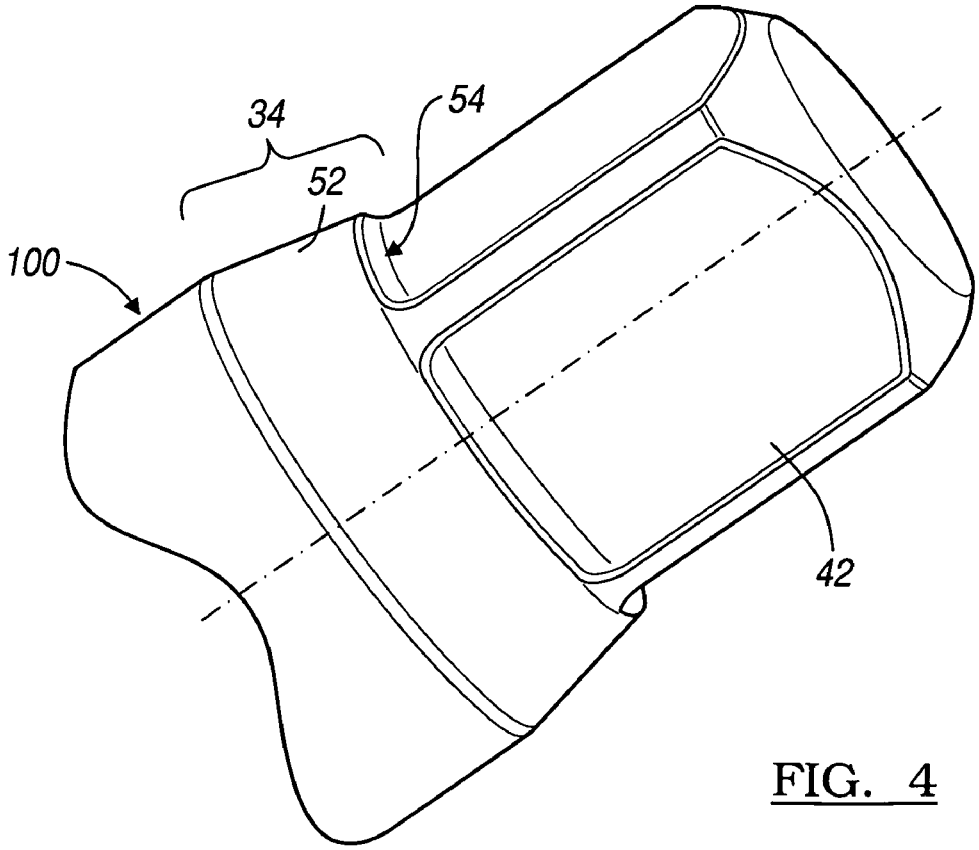
FIG. 4 is a sectional view of the anvil of FIGS. 2 and 3.

With reference now to FIGS. 3 and 4 and continued reference to FIG. 3, the transition zone 34 includes a tapered ramp 52 extending from the round body 30 to the square drive head 32. It should be understood that the tapered ramp can be eliminated by making the square head and round body of the same general diameter. The anvil 100 design introduces an increase of material in the transition zone 34 between the round body 30 and improved square drive head 32 of the anvil 100, specifically at the tapered ramp 52. This material forms a radius 54 around the circumference at the tapered ramp 52. As shown in FIG. 3, the cross-sectional area of the anvil 100 at the radius 54 is greater than the cross-sectional area of the square drive head 32. The radius 54 eliminates the sharp radii seen on the prior art design and eliminates these stress concentration zones and potential sources of failure in the anvil 100.

The anvil 100 further has a first portion 56 defined by the round body with a circular cross-section and a second portion 58 defined by the square head having a square cross-section with the transition portion defined by the tapered ramp having an exterior radius of about 2 mm. The anvil 100 has a surface with a surface finish of less than 1.8 microns. Specifically, the second portion and the transition portion have surface finishes of less than 1.6 microns, while the first portion or round body 30 has a surface roughness of less than about 0.8 microns. The surface texture of the tapered ramp 34, faces 42, radii 54 and all convex and concave transitions between have a roughness average of less than 1.6 microns Ra, regardless of the lay.

The anvil 100 has a body formed of a steel having less than 0.15% carbon and between 2 and 4% Ni and preferably between 2.95 and 3.55% Ni, and between 0.75 and 1.5% Cr and preferably between 1.0 and 1.45% Cr. Additionally, the anvil 100 preferably has 0.4-0.7% Mn, 0.15-0.3% Si, and 0.08-0.15% Mo. The combination of high Ni and Cr content, along with low carbon content, gives this material the capability to not only maintain high fatigue limits when heat treated, but also maintain very high impact strength. The alloy has a microstructure having more than 90% tempered martensite and, preferably, about 98% tempered martensite formed from a plurality of heat treatment/quenching cycles.

As previously mentioned, the anvil 100 is subjected to carburization and subsequent heat treatment. Specifically, the anvil 100 is subjected to carburization at temperatures from about 1650 to 1700° F. to bring the surface carbon level to between about 0.6 to 1.0% carbon and then quenched. The anvil is then subjected to two reheat and quench cycles to limit the amount of retained austenite. In this regard, the anvil is reheated to between 1450 and 1525° F. in a 0.6 to 1.0% Carbon atmosphere. Quenching is preferably conducted in oil at which has a temperature between 100 and 300° F. The additional heat treatment and quenching cycles are specifically necessary due to the high Ni content of the material. By successively reheating and quenching the material two times, the microstructure of the carburized case is refined and significantly improves the fatigue properties of the materials, giving the impact anvil a 2 to 10 times increase in operating life expectancy.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An anvil for an impact tool comprising:

a body formed of a steel having less than 0.15% carbon and between about 2.95 and about 3.55% Ni, and between about 1.0 and about 1.45% Cr, said body having an exterior layer having a carbon content greater than 0.15% carbon formed by carburization of the body; and a microstructure having more than 90% tempered martensite formed from a plurality of heat treatment/quenching cycles.

2. The anvil according to claim 1 having a first portion with a circular cross section and a second portion having a square cross section and a transition portion therebetween, said transition portion having an exterior radius of about 2 mm.

3. The anvil according to claim 2 wherein the first portion has a surface roughness of less than 0.8 microns.

4. The anvil according to claim 2 wherein the second portion and the transition portion have a surface roughness of less than 1.6 microns.

5. The anvil according to claim 1 having greater than about 98% by weight martensite.

6. An impact wrench comprising: an anvil having a body formed of an alloy steel having less than 0.15% C and between 2.95 and 3.55% Ni, and between 1.0 and 1.45% Cr, said body being formed of more than about 90% tempered martensite which are formed by a plurality of heating and quenching cycles.

7. The impact wrench according to claim 6 wherein the body is subject to a plurality of heat treating cycles at temperatures between about 1450 and 1525° F. having quenching cycles therebetween.

8. The impact wrench according to claim 7 wherein the body has an outer layer having a carbon content of greater than 0.6% formed by a carburization process.

9. The impact wrench according to claim 8 wherein the anvil body has a first portion with a circular cross section, and a second portion of a square cross section with a first cross-sectional area, and a transition portion therebetween, said transition portion having a second cross-sectional area greater than the first cross-sectional area.

10. The impact wrench according to claim 9 wherein the first portion has a surface finish of less than 0.8 microns.

11. The impact wrench according to claim 10 wherein the second portion and the transition portion has a surface finish of less than 1.6 microns.

* * * * *